US011365567B2

(12) United States Patent
Kim et al.

(10) Patent No.: US 11,365,567 B2
(45) Date of Patent: Jun. 21, 2022

(54) POWER CHILD LOCK SYSTEM FOR VEHICLE

(71) Applicants: Hyundai Motor Company, Seoul (KR); Kia Motors Corporation, Seoul (KR)

(72) Inventors: Hyong Don Kim, Yongin-si (KR); Yong Dae Seo, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 395 days.

(21) Appl. No.: 16/577,333

(22) Filed: Sep. 20, 2019

(65) Prior Publication Data

US 2020/0157856 A1 May 21, 2020

(30) Foreign Application Priority Data

Nov. 20, 2018 (KR) ..... 10-2018-0143875

(51) Int. Cl.

| | |
|---|---|
| ***E05B 77/26*** | (2014.01) |
| ***E05B 81/36*** | (2014.01) |
| ***E05B 41/00*** | (2006.01) |
| ***E05B 79/20*** | (2014.01) |

(52) U.S. Cl.

CPC ..... *E05B 77/265* (2013.01); *E05B 41/00* (2013.01); *E05B 79/20* (2013.01); *E05B 81/36* (2013.01); *E05Y 2900/531* (2013.01)

(58) Field of Classification Search

CPC ..... E05B 77/265; E05B 79/20; E05B 41/00; E05B 81/36; E05Y 2900/531

See application file for complete search history.

(56) References Cited

U.S. PATENT DOCUMENTS

| | | | | |
|---|---|---|---|---|
| 2018/0112441 | A1* | 4/2018 | Damboiu | E05B 77/26 |
| 2019/0234115 | A1* | 8/2019 | Seo | E05B 81/25 |
| 2020/0277808 | A1* | 9/2020 | Seo | E05B 77/32 |

FOREIGN PATENT DOCUMENTS

KR 101513000 B1 * 4/2015

* cited by examiner

*Primary Examiner* — Kristina R Fulton
*Assistant Examiner* — James Edward Ignaczewski
(74) *Attorney, Agent, or Firm* — Slater Matsil, LLP

(57) ABSTRACT

A power child lock system for a vehicle includes a power actuator, a wheel gear which is rotated by the power actuator, a child lock link which is moved by the wheel gear, a child lock lever which is moved by the child lock link, an inside lever which is connected to an inside handle assembly through a cable, a release lever which is mechanically connected to a door latch mechanism, and an indicator lever which is rotatable by the movement of the child lock link. The indicator lever is mounted to close a mounting hole of an inner panel.

20 Claims, 9 Drawing Sheets

POWER CHILD LOCK SYSTEM FOR VEHICLE

CROSS-REFERENCE TO RELATED APPLICATIONS

This application claims priority to Korean Patent Application No. 10-2018-0143875, filed in the Korean Intellectual Property Office on Nov. 20, 2018, which application is hereby incorporated herein by reference.

TECHNICAL FIELD

The present disclosure relates to a power child lock system for a vehicle.

BACKGROUND

A power child lock system for a vehicle may be configured to prevent the rear doors of the vehicle from being opened inside the vehicle and to allow the rear doors to be opened only outside the vehicle.

The power child lock system may be classified into a power child lock system operated by a power actuator, and a manual child lock system operated manually.

The power child lock system may have a child lock switch disposed near the driver's seat, and the power actuator may be driven by the child lock switch.

The manual child lock system may have a manual lever mounted on an inner panel of the rear door, and the manual lever may be moved by a user's manual operation between a lock position and an unlock position. The rear door to which the manual child lock system is applied may have a mounting hole and symbol marks formed in the inner panel thereof. The manual lever may be mounted in the mounting hole, and the symbol marks may indicate the lock position and the unlock position.

The rear door to which the power child lock system is applied may not require the mounting hole and the symbol marks in the inner panel thereof, while the rear door to which the manual child lock system is applied may require the mounting hole and the symbol marks in the inner panel thereof.

Some vehicles, to which the power child lock system and the manual child lock system are selectively applied, may be supplied with two types of inner panels by dualizing an inner panel of the rear door to which the power child lock system is applied and an inner panel of the rear door to which the manual child lock system is applied. That is, it may be required to load the inner panels by separating the inner panels, each of which being provided with the mounting hole and the symbol marks (the inner panels to which the manual child lock system is applied) from the inner panels, each of which being provided with the mounting hole and the symbol marks (the inner panels to which the power child lock system is applied), resulting in insufficient space for loading them in a vehicle manufacturing plant. In addition, different types of inner panels need to be individually supplied, increasing the manufacturing cost by about 6,500 won (KRW) per vehicle.

Meanwhile, in order to supply the inner panels of the rear doors by unifying them, the inner panels provided with the mounting holes and the symbol marks have been supplied to all vehicles to which the power child lock system and the manual child lock system are applied, and as for vehicles to which the power child lock system is applied, they have employed a method of sealing the mounting hole by inserting a plug into the mounting hole. However, the insertion of the plug into the mounting hole may be frequently missed during assembly.

The above information described in this background section is provided to assist in understanding the background of the inventive concept, and may include any technical concept which is not considered as the prior art that is already known to those skilled in the art.

SUMMARY

The present disclosure relates to a power child lock system for a vehicle and, in particular embodiments, to a power child lock system for a vehicle having an indicator lever for selectively indicating a lock position and an unlock position.

Embodiments of the present disclosure can solve above-mentioned problems occurring in the prior art while advantages achieved by the prior art are maintained intact.

An aspect of the present disclosure provides a power child lock system for a vehicle having an indicator lever for selectively indicating a lock position and an unlock position.

According to an aspect of the present disclosure, a power child lock system for a vehicle, which is mounted in an inner panel of a vehicle door, may include a power actuator, a wheel gear which is rotated by the power actuator, a child lock link which is moved by rotation of the wheel gear, a child lock lever which is moved by rotation of the wheel gear, an inside lever which is connected to an inside handle assembly through a cable, a release lever which is mechanically connected to a door latch mechanism, and is detachably connected to the inside lever, and an indicator lever which is rotatable by the movement of the child lock link. The indicator lever may be mounted to close a mounting hole of the inner panel.

The indicator lever may be disposed under the mounting hole and a diameter of the indicator lever may be larger than a diameter of the mounting hole of the inner panel.

The indicator lever may have two protrusions spaced apart from each other, and the child lock link may be fitted between the protrusions of the indicator lever.

A helical gear may be coupled to an output shaft of the power actuator, and the wheel gear may have a toothed portion meshing with the helical gear.

The wheel gear may have a contact protrusion which is brought into contact with the child lock lever, and the contact protrusion of the wheel gear may press the child lock lever by the rotation of the wheel gear to cause the child lock lever to move.

The inside lever and the release lever may be engaged or disengaged by movement of the child lock lever.

The child lock lever may have a post, the inside lever may have a first guide slot along which the post is guided, and the release lever may have a second guide slot along which the post is guided.

The first guide slot may be aligned with the second guide slot, and a length of the first guide slot may be shorter than a length of the second guide slot.

The inside lever may be engaged to the release lever as the post is inserted into the first guide slot and the second guide slot simultaneously, and the inside lever may be disengaged from the release lever as the post is released from the first guide slot.

The inside lever and the release lever may pivot around one pivot pin.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION OF ILLUSTRATIVE EMBODIMENTS

Figure 1:
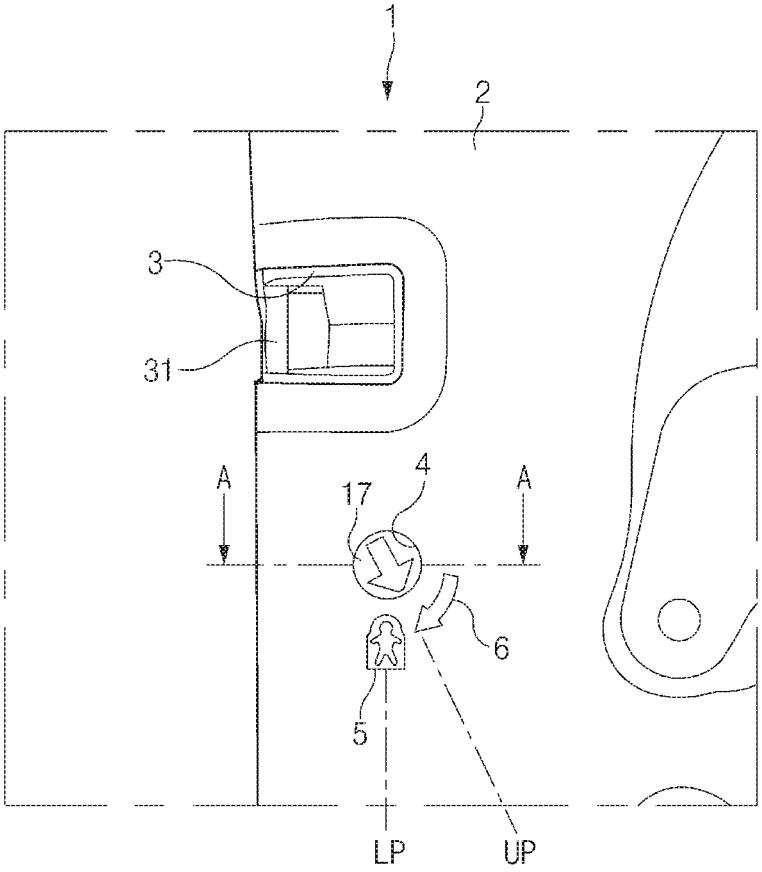
FIG. 1 illustrates a portion of an inner panel of a vehicle door according to an exemplary embodiment of the present disclosure.

Hereinafter, exemplary embodiments of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Figure 2:
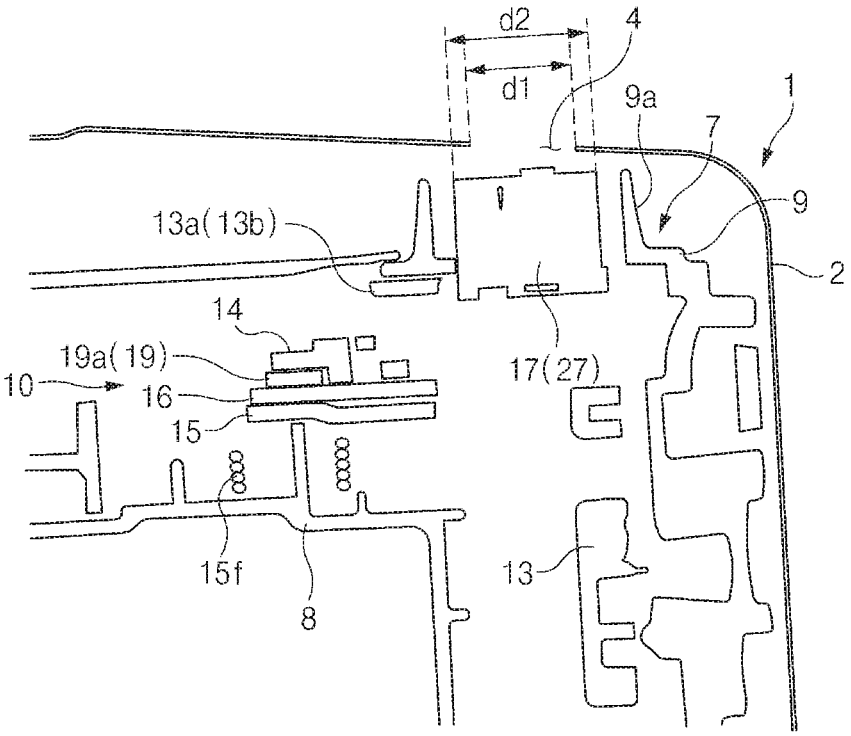
FIG. 2 illustrates a cross-sectional view taken along line A-A in FIG. 1.

Referring to FIGS. 1 and 2, a vehicle door 1 may include an inner panel 2, and the inner panel 2 may have a latch opening 3 in which a door latch 31 of a door latch mechanism 30 is rotatably mounted. When a striker (not shown) fixed to a vehicle body is guided along the latch opening 3, the door latch 31 may be coupled to the striker. For example, the vehicle door 1 may be a rear door.

In addition, the inner panel 2 may have a mounting hole 4 adjacent to the latch opening 3 and symbol marks 5 and 6. An indicator lever 17 of a power child lock system 10 or a manual lever 27 of a manual child lock system 20 (see FIG. 9) may be aligned with the mounting hole 4 of the inner panel 2, and the indicator lever 17 or the manual lever 27 may be disposed under the mounting hole 4 of the inner panel 2 such that the indicator lever 17 or the manual lever 27 (see FIG. 9) may close the mounting hole 4 of the inner panel 2. The symbol marks 5 and 6 may include a first symbol 5 indicating a lock position LP of the child lock systems 10 and 20, and a second symbol 6 indicating a direction toward the first symbol 5.

According to an exemplary embodiment, a diameter d2 of the manual lever 27 or the indicator lever 17 may be larger than a diameter d1 of the mounting hole 4 of the inner panel 2. Thus, the manual lever 27 or the indicator lever 17 may more reliably close the mounting hole 4 of the inner panel 2, thereby preventing a user from arbitrarily operating the manual lever 27 or the indicator lever 17 using a tool such as a driver.

As illustrated in FIG. 2, a latch housing 7 may be installed in the inner panel 2, and the latch housing 7 may have a back plate 8 and a latch cover 9. Components of the child lock systems 10 and 20 may be installed between the back plate 8 and the latch cover 9 of the latch housing 7. In addition, components of the door latch mechanism 30 may be installed between the back plate 8 and the latch cover 9 of the latch housing 7.

Figure 3:
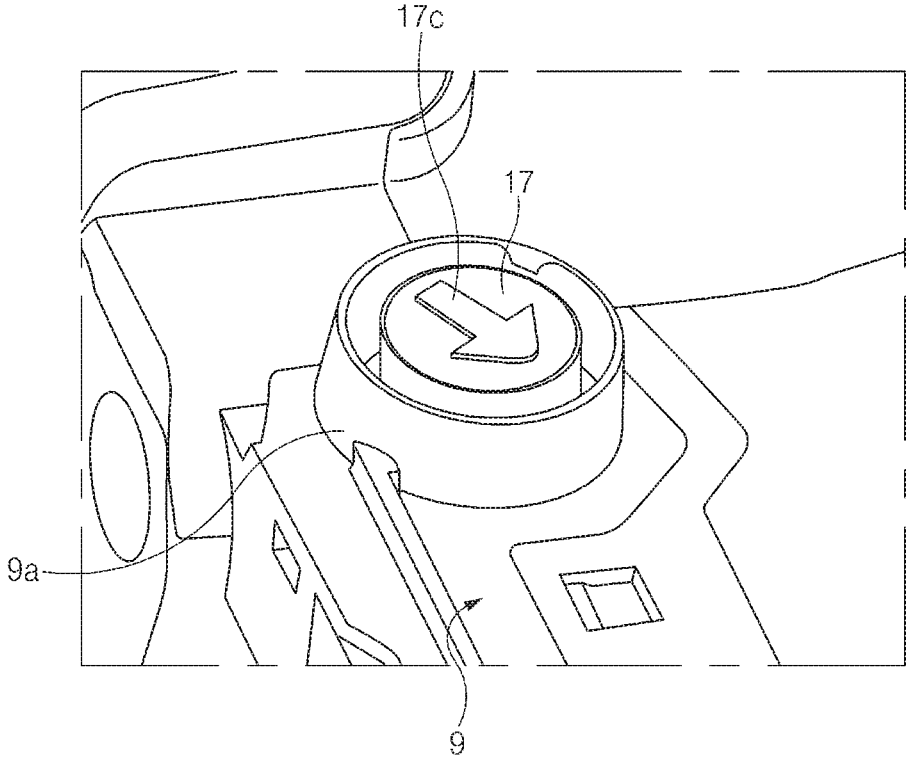
FIG. 3 illustrates a perspective view of a latch cover and an indicator lever of an inner panel of a vehicle door according to an exemplary embodiment of the present disclosure.

Referring to FIG. 3, the latch cover 9 may have a mounting boss 9*a* on which the indicator lever 17 or the manual lever 27 (see FIG. 9) is mounted, and the mounting boss 9*a* may be aligned with the mounting hole 4 of the inner panel 2. For example, an axis of the mounting boss 9*a* may coincide with an axis of the mounting hole 4.

Figure 4:
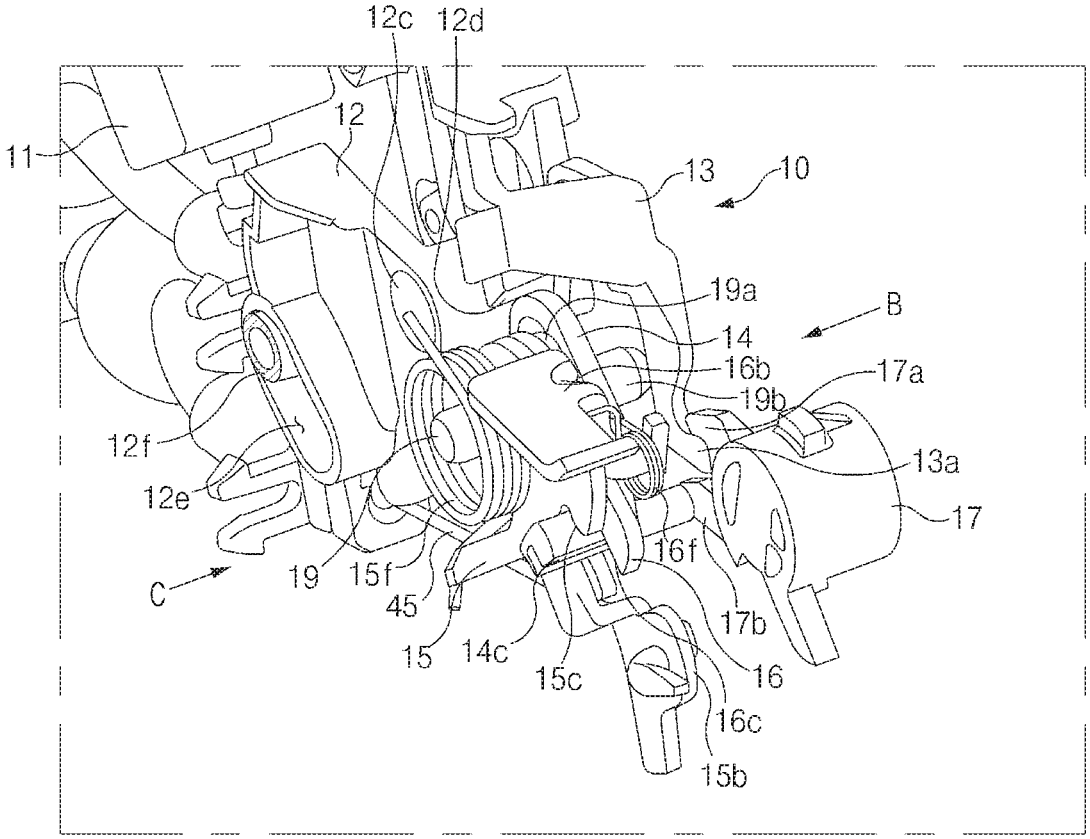
FIG. 4 illustrates a perspective view of a power child lock system for a vehicle according to an exemplary embodiment of the present disclosure.
Figure 5:
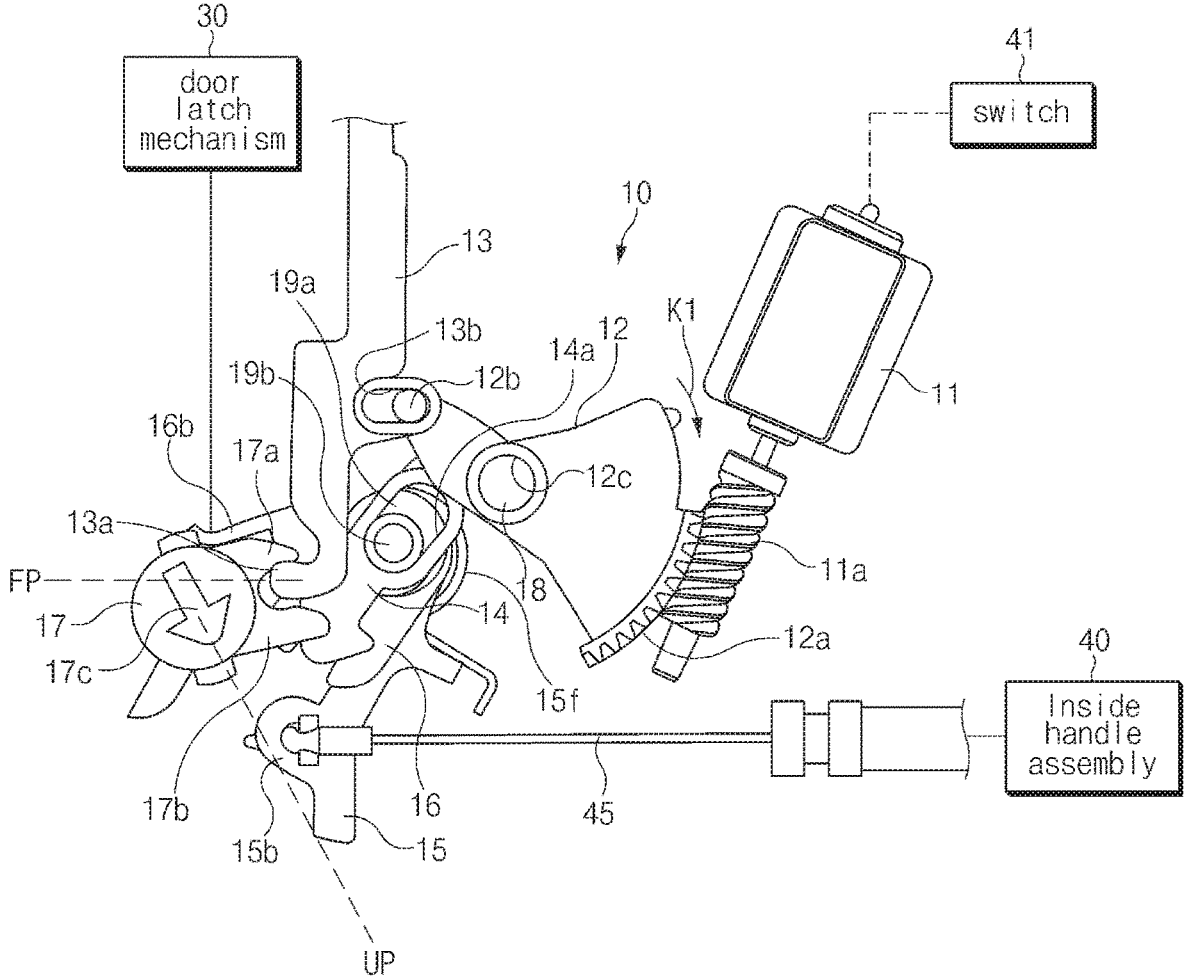
FIG. 5 illustrates a plan view in a direction of arrow B of FIG. 4, in which a power child lock system for a vehicle according to an exemplary embodiment of the present disclosure is in an unlock state.
Figure 6:
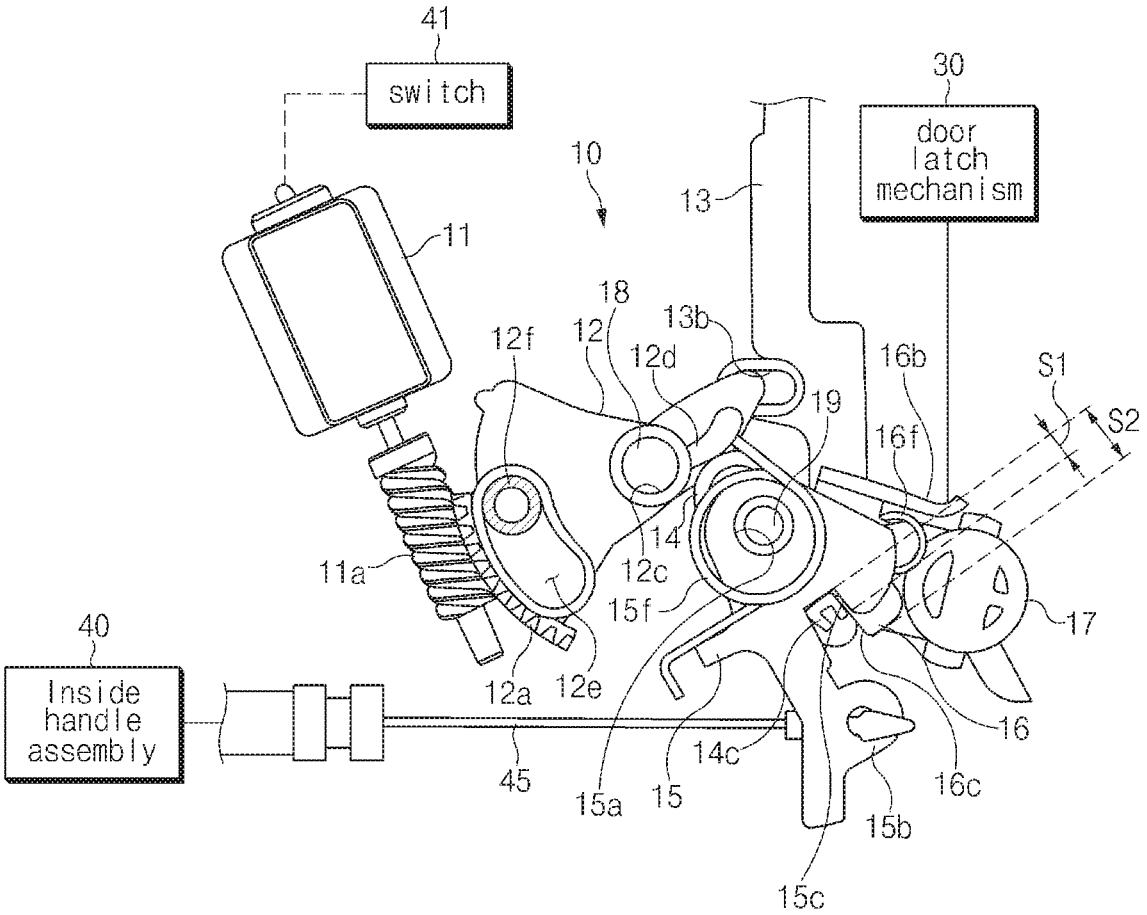
FIG. 6 illustrates a bottom view in a direction of arrow C of FIG. 4, in which a power child lock system for a vehicle according to an exemplary embodiment of the present disclosure is in an unlock state.

Referring to FIGS. 4 to 6, the power child lock system 10 for a vehicle according to an exemplary embodiment of the present disclosure may include a power actuator 11, a wheel gear 12 which is rotated by the power actuator 11, a child lock link 13 which is moved by the rotation of the wheel gear 12, a child lock lever 14 which is moved by the rotation of the wheel gear 12, an inside lever 15 which is connected to an inside handle assembly 40 through a cable 45, a release lever 16 which is mechanically connected to the door latch mechanism 30, and the indicator lever 17 which is rotatable by the child lock link 13.

The power actuator 11 may be electrically connected to a child lock switch 41, and the power actuator 11 may be powered by operating the child lock switch 41. The child lock switch 41 may be disposed adjacent to the driver's seat. A helical gear 11*a* may be coupled to an output shaft of the power actuator 11.

The wheel gear 12 may have a toothed portion 12*a* formed at one end thereof, a guide protrusion 12*b* formed at the other end thereof, and a hole 12*c* formed in a central portion thereof. The toothed portion 12*a* of the wheel gear 12 may mesh with the helical gear 11*a*, and a shaft 18 may be inserted into the hole 12*c* of the wheel gear 12. The shaft 18 may protrude from the back plate 8 of the latch housing 7. As the helical gear 11*a* is rotated by the power actuator 11, the wheel gear 12 may rotate around the shaft 18.

As illustrated in FIGS. 4 and 6, the wheel gear 12 may have a contact protrusion 12*d* which is brought into contact with the child lock lever 14. As the wheel gear 12 rotates around the shaft 18, the contact protrusion 12*d* may press a top end of the child lock lever 14 to cause the child lock lever 14 to move in a diagonal direction.

As illustrated in FIG. 6, the wheel gear 12 may have a guide slot 12*e* adjacent to the toothed portion 12*a*, and a protrusion 12*f* may be guided along the guide slot 12*e*. The protrusion 12*f* may protrude from the back plate 8 of the latch housing 7. The rotation of the wheel gear 12 may be guided by the guide slot 12*e* and the protrusion 12*f*.

The child lock link 13 may have a protrusion 13*a* formed at one end thereof, and a slot 13*b* extending horizontally in a center portion thereof. The protrusion 13*a* of the child lock link 13 may be connected to the indicator lever 17, and the guide protrusion 12*b* of the wheel gear 12 may be guided along the slot 13*b* of the child lock link 13 in a horizontal direction. As the guide protrusion 12*b* of the wheel gear 12 moves along the slot 13*b* of the child lock link 13 in the horizontal direction by the rotation of the wheel gear 12, the child lock link 13 may move in a vertical direction. That is, the rotational motion of the wheel gear 12 may be converted into the vertical linear motion of the child lock link 13 through the guide protrusion 12*b* and the slot 13*b*.

The child lock lever 14 may have a guide slot 14*a* adjacent to the top end thereof, and a post 14*c* adjacent to a bottom end thereof. The child lock lever 14 may be disposed in an inclined direction. As illustrated in FIGS. 4 and 6, the top end of the child lock lever 14 may contact the contact protrusion 12*d* of the wheel gear 12. As the wheel gear 12 rotates, the contact protrusion 12*d* of the wheel gear 12 may press the top end of the child lock lever 14 in the inclined direction to cause the child lock lever 14 to move in the inclined direction.

The inside lever 15 may have a pivot hole 15*a* formed in one end thereof, and a coupling portion 15*b* formed at the other end thereof. The coupling portion 15*b* of the inside lever 15 may be connected to the inside handle assembly 40 through the cable 45, and the inside lever 15 may pivot by the operation of an inside handle of the inside handle assembly 40. The inside lever 15 may return to its original position by an elastic force of a first torsion spring 15*f*.

The inside lever 15 may have a first guide slot 15*c* formed in the other end thereof, and the post 14*c* of the child lock lever 14 may be guided along the first guide slot 15*c* of the inside lever 15.

The release lever 16 may be interposed between the child lock lever 14 and the inside lever 15, and the release lever 16 may have a pivot hole (not shown) aligned with the pivot hole 15*a* of the inside lever 15, and a connection piece 16*b* mechanically connected to the door latch mechanism 30. The release lever 16 may return to its original position by an elastic force of a second torsion spring 16*f*. The second torsion spring 16*f* may be disposed between the release lever 16 and the child lock lever 14, and the child lock lever 14 may return to its original position by the elastic force of the second torsion spring 16*f*.

The release lever 16 may have a second guide slot 16*c* formed in the other end thereof, and the post 14*c* of the child lock lever 14 may be guided along the second guide slot 16*c* of the release lever 16.

The pivot hole 15*a* of the inside lever 15 may be aligned with the pivot hole (not shown) of the release lever 16, and a pivot pin 19 may be inserted into the pivot hole 15*a* of the inside lever 15 and the pivot hole of the release lever 16. Thus, the inside lever 15 and the release lever 16 may pivot around one pivot pin 19.

The pivot pin 19 may have a flange 19*a* interposed between the release lever 16 and the child lock lever 14, and a guide protrusion 19*b* extending from the flange 19*a*. The guide protrusion 19*b* of the pivot pin 19 may be inserted into the guide slot 14*a* of the child lock lever 14, and the pivot pin 19 may be fixed to the back plate 8 of the latch housing 7. The guide slot 14*a* of the child lock lever 14 may be guided along the guide protrusion 19*b* of the pivot pin 19.

Figure 8:
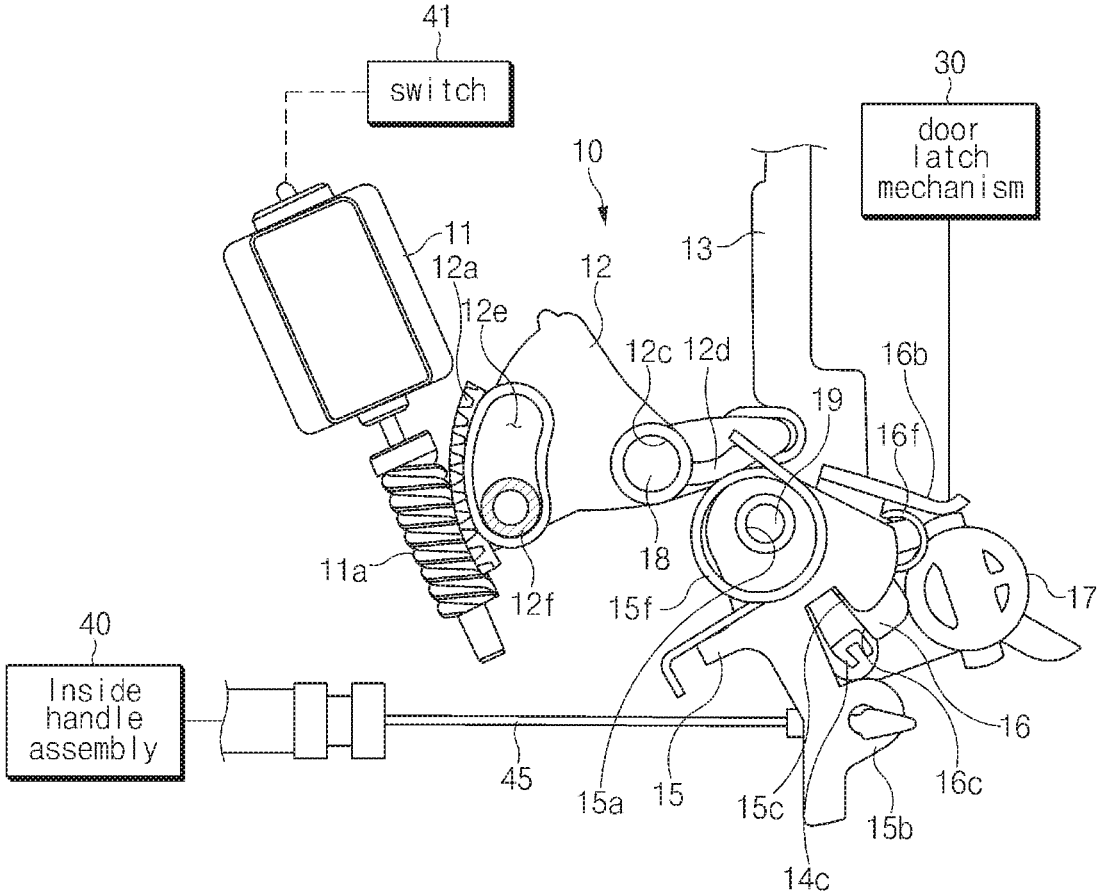
FIG. 8 illustrates a bottom view in which a power child lock system for a vehicle according to an exemplary embodiment of the present disclosure is in a lock state.

The first guide slot 15*c* of the inside lever 15 may be aligned with the second guide slot 16*c* of the release lever 16, and a length S1 of the first guide slot 15*c* may be shorter than a length S2 of the second guide slot 16*c*. As illustrated in FIG. 6, the post 14*c* of the child lock lever 14 may be inserted into the first guide slot 15*c* and the second guide slot 16*c* simultaneously so that the inside lever 15 and the release lever 16 may be engaged by the child lock lever 14, and thus the inside lever 15 and the release lever 16 may pivot together. As illustrated in FIG. 8, the post 14*c* of the child lock lever 14 may be released from the first guide slot 15*c* so that the inside lever 15 and the release lever 16 may be disengaged by the child lock lever 14, and thus the inside lever 15 and the release lever 16 may not pivot together.

The indicator lever 17 may have a cylindrical structure having an arrow symbol 17*c* indicating a direction. The indicator lever 17 may have two protrusions 17*a* and 17*b* spaced apart from each other in a circumferential direction thereof, and the arrow symbol 17*c* may be embossed on a top surface of the indicator lever 17. The protrusion 13*a* of the child lock link 13 may be fitted between the protrusions 17*a* and 17*b* of the indicator lever 17. As the child lock link 13 moves in the vertical direction, the indicator lever 17 may move between the lock position LP and an unlock position UP.

FIGS. 5 and 6 illustrate an unlock state of the power child lock system 10. As illustrated in FIGS. 5 and 6, as the wheel gear 12 is rotated in a clockwise direction (see K1 direction in FIG. 5) by the power actuator 11, the guide protrusion 12*b* of the wheel gear 12 may move to one end (the right end in FIG. 5) of the slot 13*b* of the child lock link 13. As the child lock link 13 moves to a first position FP, the indicator lever 17 may move to the unlock position UP. The child lock lever 14 may contact the contact protrusion 12*d* of the wheel gear 12 by the elastic force of the second torsion spring 16*f*, and the post 14*c* of the child lock lever 14 may be inserted into the guide slot 15*c* of the inside lever 15 and the guide slot 16*c* of the release lever 16 simultaneously. Thus, the inside lever 15 may be engaged to the release lever 16 through the child lock lever 14. That is, as the inside lever 15 and the release lever 16 are engaged, the power child lock system 10 may become unlocked. When the user pulls the inside handle of the inside handle assembly 40 in the unlock state of the power child lock system 10, the cable 45 may be pulled, and accordingly, the inside lever 15 and the release lever 16 move (pivot) together, and the release lever 16 may lock or unlock the door latch 31 of the door latch mechanism 30. That is, by pulling or releasing the inside handle of the inside handle assembly 40 in the unlock state of the power child lock system 10, the user may open or close the vehicle door 1 in the interior space of the vehicle.

Figure 7:
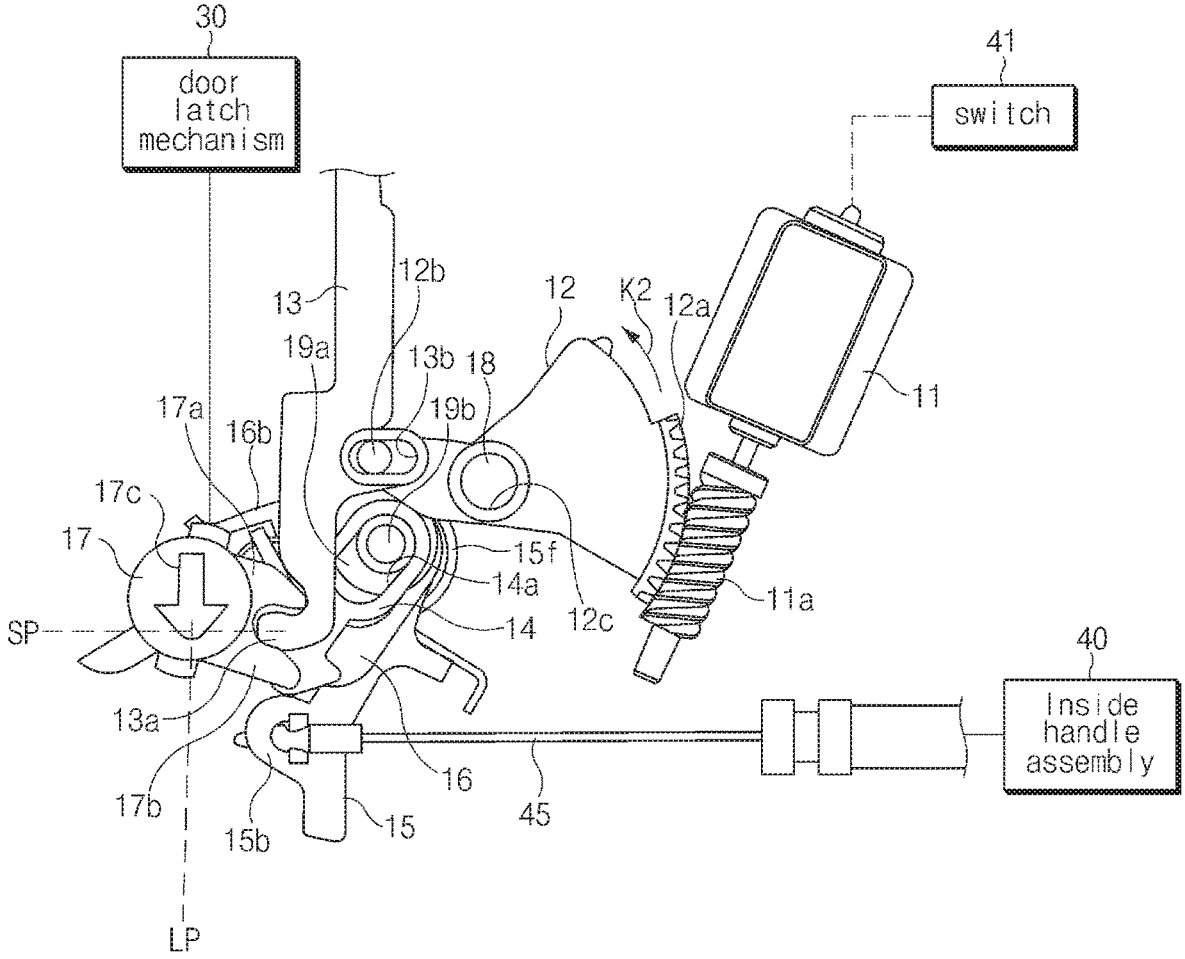
FIG. 7 illustrates a plan view in which a power child lock system for a vehicle according to an exemplary embodiment of the present disclosure is in a lock state.

FIGS. 7 and 8 illustrate a lock state of the power child lock system 10. As illustrated in FIGS. 7 and 8, as the wheel gear 12 is rotated in a counterclockwise direction (see K2 direction in FIG. 7) by the power actuator 11, the guide protrusion 12*b* of the wheel gear 12 may move to the other end (the left end in FIG. 7) of the slot 13*b* of the child lock link 13. As the child lock link 13 moves to a second position SP, the indicator lever 17 may be in the lock position LP. The contact protrusion 12*d* of the wheel gear 12 may press the child lock lever 14, and the post 14*c* of the child lock lever 14 may be released from the guide slot 15*c* of the inside lever 15. Accordingly, the inside lever 15 and the release lever 16 may be disengaged from each other. As the inside lever 15 and the release lever 16 are disengaged, the power child lock system 10 may become locked. When the user pulls the inside handle of the inside handle assembly 40 in the lock state of the power child lock system 10, the cable 45 may be pulled. By pulling the cable 45, the inside lever 15 may move (pivot) alone, and the release lever 16 may not move (pivot), and thus the lock state of the door latch 31 may be maintained. That is, although the inside handle of the inside handle assembly 40 is pulled in the lock state of the power child lock system 10, the lock state of the door latch 31 may be maintained, thereby preventing the user from arbitrarily opening the vehicle door 1 in the interior space of the vehicle.

Figure 9:
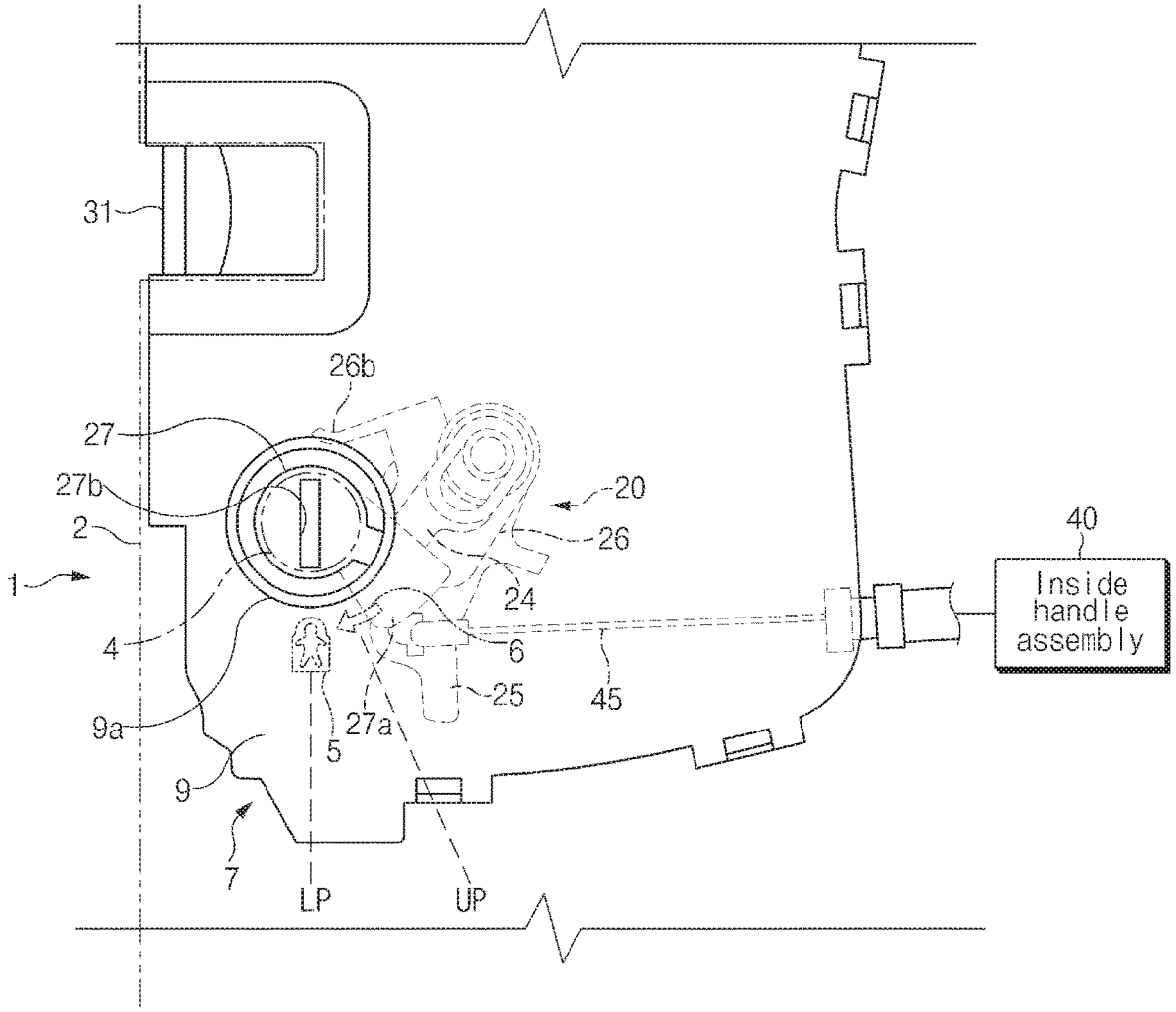
FIG. 9 illustrates a state in which a power child lock system for a vehicle according to an exemplary embodiment of the present disclosure is mounted on an inner panel of a vehicle door.

Referring to FIG. 9, the manual child lock system 20 may be mounted on the inner panel 2 of the vehicle door 1. The manual lever 27 of the manual child lock system 20 may be mounted in the mounting hole 4 of the inner panel 2. The manual lever 27 may have an insertion groove 27*a* into which a tool such as a driver is inserted. Thus, the user may manually rotate the manual lever 27 so that the manual lever 27 may move between the lock position LP and the unlock position UP.

The manual child lock system 20 may include a child lock lever 24 connected to the manual lever 27, an inside lever 25 connected to the inside handle assembly 40 through the cable 45, and a release lever 26 mechanically connected to the door latch mechanism 30.

The child lock lever 24 may be connected to the manual lever 27 so that it may be moved by the rotation of the manual lever 27.

According to an exemplary embodiment, the connections of the child lock lever 24, the inside lever 25, and the release lever 26 may be substantially the same as or similar to the connections of the child lock lever 14, the inside lever 15, and the release lever 16 illustrated in FIGS. 4 to 8.

According to the exemplary embodiments of the present disclosure, by applying the indicator lever 17 which seals the mounting hole 4 of the inner panel of the rear door, the mounting hole 4 and the symbol marks 5 and 6 may be kept in the inner panel of the rear door, regardless of the power child lock system 10 and the manual child lock system 20. Thus, one type of inner panel may be supplied, and the manufacturing cost may be reduced (about 200 won (KRW) per vehicle).

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A power child lock system to be mounted in an inner panel of a vehicle door, the power child lock system comprising:

a power actuator;

a wheel gear that is rotatable by the power actuator;

a child lock link that is movable by rotation of the wheel gear;

a child lock lever that is movable by rotation of the wheel gear, wherein the child lock lever has a post;

an inside lever connected to an inside handle assembly through a cable, wherein the inside lever has a first guide slot along which the post is guided;

a release lever mechanically connected to a door latch mechanism and detachably connected to the inside lever, wherein the release lever has a second guide slot along which the post is guided; and an indicator lever that is rotatable by movement of the child lock link, wherein the indicator lever is mounted to close a mounting hole of the inner panel.

2. The power child lock system according to claim 1, wherein the indicator lever has two protrusions spaced apart from each other, and wherein the child lock link is fitted between the protrusions of the indicator lever.

3. The power child lock system according to claim 1, wherein a helical gear is coupled to an output shaft of the power actuator and wherein the wheel gear has a toothed portion meshing with the helical gear.

4. The power child lock system according to claim 1, wherein the wheel gear has a contact protrusion which is brought into contact with the child lock lever and wherein the contact protrusion of the wheel gear is configured to press the child lock lever by rotation of the wheel gear to cause the child lock lever to move.

5. The power child lock system according to claim 1, wherein the inside lever and the release lever are engaged or disengaged by movement of the child lock lever.

6. The power child lock system according to claim 1, wherein the first guide slot is aligned with the second guide slot, and wherein a length of the first guide slot is shorter than a length of the second guide slot.

7. The power child lock system according to claim 6, wherein the inside lever is engaged to the release lever as the post is inserted into the first guide slot and the second guide slot simultaneously, and wherein the inside lever is disengaged from the release lever as the post is released from the first guide slot.

8. The power child lock system according to claim 1, wherein the inside lever and the release lever pivot around one pivot pin.

9. A power child lock system to be mounted in an inner panel of a vehicle door, the power child lock system comprising:

a power actuator;

a wheel gear that is rotatable by the power actuator;

a child lock link that is movable by rotation of the wheel gear;

a child lock lever that is movable by rotation of the wheel gear, wherein the child lock lever has a post;

an inside lever connected to an inside handle assembly through a cable, wherein the inside lever has a first guide slot along which the post is guided;

a release lever mechanically connected to a door latch mechanism and detachably connected to the inside lever, wherein the release lever has a second guide slot along which the post is guided; and an indicator lever that is rotatable by movement of the child lock link, wherein the indicator lever is mounted to close a mounting hole of the inner panel, wherein the indicator lever is disposed under the mounting hole and wherein a diameter of the indicator lever is larger than a diameter of the mounting hole of the inner panel.

10. The power child lock system according to claim 9, wherein the indicator lever has two protrusions spaced apart from each other, and wherein the child lock link is fitted between the protrusions of the indicator lever.

11. The power child lock system according to claim 9, wherein a helical gear is coupled to an output shaft of the power actuator and wherein the wheel gear has a toothed portion meshing with the helical gear.

12. The power child lock system according to claim 9, wherein the wheel gear has a contact protrusion which is brought into contact with the child lock lever and wherein the contact protrusion of the wheel gear is configured to press the child lock lever by rotation of the wheel gear to cause the child lock lever to move.

13. A vehicle comprising:

a vehicle body;

a vehicle door attached to the vehicle body, the vehicle door including an inner panel and an inside handle assembly;

a power actuator;

a wheel gear that is rotatable by the power actuator;

a child lock link that is movable by rotation of the wheel gear;

a child lock lever that is movable by rotation of the wheel gear, wherein the child lock lever has a post;

an inside lever connected to the inside handle assembly through a cable, wherein the inside lever has a first guide slot along which the post is guided;

a release lever mechanically connected to a door latch mechanism and detachably connected to the inside lever, wherein the release lever has a second guide slot along which the post is guided; and an indicator lever that is rotatable by movement of the child lock link, wherein the indicator lever is mounted to close a mounting hole of the inner panel.

14. The vehicle according to claim 13, wherein the vehicle door comprises a rear vehicle door.

15. The vehicle according to claim 13, wherein the indicator lever is disposed under the mounting hole and wherein a diameter of the indicator lever is larger than a diameter of the mounting hole of the inner panel.

16. The vehicle according to claim 13, wherein the indicator lever has two protrusions spaced apart from each other, and wherein the child lock link is fitted between the protrusions of the indicator lever.

17. The vehicle according to claim 13, wherein a helical gear is coupled to an output shaft of the power actuator and wherein the wheel gear has a toothed portion meshing with the helical gear.

18. The vehicle according to claim 13, wherein the wheel gear has a contact protrusion which is brought into contact with the child lock lever and wherein the contact protrusion of the wheel gear is configured to press the child lock lever by rotation of the wheel gear to cause the child lock lever to move.

19. The vehicle according to claim 13, wherein the inside lever and the release lever are engaged or disengaged by movement of the child lock lever.

20. The vehicle according to claim 13, wherein the inside lever and the release lever pivot around one pivot pin.

* * * * *